US005582226A

United States Patent [19]

Voss et al.

[11] Patent Number: 5,582,226

[45] Date of Patent: Dec. 10, 1996

[54] VENETIAN BLIND

[75] Inventors: Robert J. Voss, Fountain Valley; Louis G. Valle, Huntington Beach; Zeki Tuzmen, Irvine, all of Calif.

[73] Assignee: Newell Operating Company, Freeport, Ill.

[21] Appl. No.: 564,900

[22] Filed: Nov. 29, 1995

Related U.S. Application Data

[63] Continuation of Ser. No. 232,866, Apr. 25, 1994, abandoned, which is a continuation of Ser. No. 75,204, Jun. 10, 1993, abandoned.

[51] Int. Cl.[6] ..... E06B 9/30

[52] U.S. Cl. ..... 160/168.1 R; 160/176.1; 160/178.3

[58] Field of Search ..... 160/168.1 R, 168.1 V, 160/176.1 R, 176.1 V, 177 R, 178.1 R, 178.3, 236

[56] References Cited

U.S. PATENT DOCUMENTS

| | | | |
|---|---|---|---|
| 262,399 | 8/1882 | Gibson . | |
| 424,061 | 3/1890 | Hawley . | |
| 1,434,867 | 11/1922 | Wilson . | |
| 2,072,464 | 3/1937 | Nisenson | 160/178.3 X |
| 2,107,432 | 2/1938 | Thompson | 160/176.1 X |
| 2,164,814 | 7/1939 | Griffith | 160/176.1 X |
| 2,576,159 | 11/1951 | Walker | 160/178.3 |
| 2,652,111 | 9/1953 | Walker | 160/168.1 R |
| 2,821,247 | 1/1958 | Satosky | 160/176.1 |
| 2,994,370 | 8/1961 | Pinto . | |
| 3,170,505 | 2/1965 | Lorentzen et al. | 160/178.3 X |
| 3,389,737 | 6/1968 | Arnold et al. | 160/176.1 X |
| 4,493,357 | 1/1985 | Anderson . | |
| 4,530,930 | 7/1985 | Schluep et al. | 160/178.3 |
| 4,664,169 | 5/1987 | Osaka et al. . | |
| 4,708,188 | 11/1987 | Bytheway, Jr. . | |
| 4,951,729 | 8/1990 | Chi Yu . | |
| 4,958,421 | 9/1990 | Spangenberg . | |
| 5,092,387 | 3/1992 | King et al. | 160/176.1 |
| 5,165,459 | 11/1992 | Gaber et al. | 160/176.1 X |

FOREIGN PATENT DOCUMENTS

| | | | |
|---|---|---|---|
| 563344 | 5/1957 | Italy | 160/176.1 |

*Primary Examiner*—Blair Johnson
*Attorney, Agent, or Firm*—Foley & Lardner

[57] ABSTRACT

A venetian blind assembly is provided in which each of the slats are provided with at least two pairs of holes, with the pairs of holes being spaced from each other along the lengths of the slats and with the holes of each pair being located across the width of the slat from each other and adjacent to opposite edges of the slats. Each of the holes is connected to adjacent edges of the slat by a slit, whereby the rung cords of the ladder assembly supporting the slats may be inserted through the slits into the holes to retain the slats in a predetermined position. The lifting cords for the blinds are located beyond the edges of the slats, such that when the vertical cords of the ladder assemblies are vertically adjusted with respect to each other, the slats may be moved to a closed position wherein the lower edge of one slat engages the top surface of the other to more completely prevent the infiltration of light or sound or the movement of air therebetween. A downwardly extending projection is provided on the lower surface of the headrail, such that it is engaged by the upper surface of the uppermost slat to prevent the infiltration of light or sound therebetween when the slats are in their closed position.

8 Claims, 3 Drawing Sheets

VENETIAN BLIND

This is a continuation application Ser. No. 232,866 filed on Apr. 25, 1994 abandoned, which is continuation of application Ser. No. 08/075,204 filed on Jun. 10, 1993 now abandoned.

BACKGROUND OF THE INVENTION

Field of the Invention

This invention relates to a venetian blind and a method of assembling the venetian blind. It has been a continuing desire to reduce the infiltration of light between the slats of venetian blinds when in the closed position. Improvements in venetian blinds have also been directed toward simplifying both their assembly, and the replacement of damaged slats.

BACKGROUND INFORMATION

In the past, venetian blinds have typically been constructed with lift cords extending through holes located in the center of the width of the slats. It has been recognized that this location of the lift cords prevents the slats from fully closing upon each other so as to substantially prevent the infiltration of light between the slats. With minimum light infiltration being desirable, and with a major cause of light infiltration having been recognized as the lift cords extending through the center of the slats, prior attempts have been made to provide a venetian blind structure which eliminates lift cords extending through the center of the slat.

One such structure is shown in U.S. Pat. No. 4,951,729—Chi Yu, issued Aug. 28, 1990. The Chi Yu patent reveals a venetian blind structure having a slat unit formed with first and second elongated members adjacent to and hingedly attached to one another. The lift cords extend through one of the members such that the second members of each of the slats are free to tilt and to engage each other when the blind slats are placed in the closed position. While this arrangement appears to permit close engagement of adjacent slats, so as to reduce the infiltration of light, the structure is quite complex. Each slat is formed with two core members, both of which are wrapped with a fabric sheet which is pinched or bound along a line between the core member so as to form a hinge. It is readily recognized that this construction will add considerably to the cost of a blind as compared to a blind formed with slats having only a single rigid member and not requiring a fabric wrapping.

SUMMARY OF THE INVENTION

It is an object of this invention to provide a venetian blind assembly, including an array of elongated slats, which is more effective in preventing the infiltration of light, air and sound from one side of the blind structure to the other, than blind structures in which holes are provided in the center of each slat for the purpose of receiving lifting cords. It is another object of the present invention to provide a venetian blind assembly which eliminates the need for center holes in the slats, and which instead locates the lifting cords beyond the outer edges of the slats. It is another object of the invention to provide a blind assembly wherein each of the ladder rung cords supporting a slat is received within at lease one and preferably two holes in the slat so as to maintain the slat in a predetermined position in the blind assembly. It is another object of the invention to provide a blind assembly in which the slats may be readily secured to the rung cords of a ladder assembly, and in which an individual slat may be readily removed and replaced. It is a still further object of the invention to provide a blind assembly in which the blind slats may be secured to the ladder rungs in such a manner that the ladder rungs do not, or minimally interfere with the engagement of the slats with each other so as to prevent light infiltration when the blind is in the closed position.

In accordance with this invention, a blind assembly is provided in which the individual blind slats are preferably provided with at least two pairs of holes. The pairs of holes are spaced from each other along the length of the slats, with the holes of each pair being located across the width of the slat from each other and adjacent to opposite edges of the slat. Further, each of the holes is connected to the adjacent edge of the slat by a slit or cut. The slats are supported by ladder cord assemblies. Each rung cord of a ladder assembly is inserted through the bottom of the slits or cuts into a pair of holes. Thus, the rung cord passes over the upper surface of the slat adjacent the edges and lies underneath the central portion of the slat.

The lift cords for the blind assembly are located beyond the edges of the blind slats, such that it is not necessary to provide holes in the slats to receive the lift cords. When the vertical cords of the ladder assembly are vertically shifted with respect to each other, the lower edge of a slat will engage the top surface of the next lower slat along its full length, so as to essentially prevent light, air and sound infiltration between the closed slats.

DETAILED DESCRIPTION OF THE PREFERRED EMBODIMENT

Figure 1:
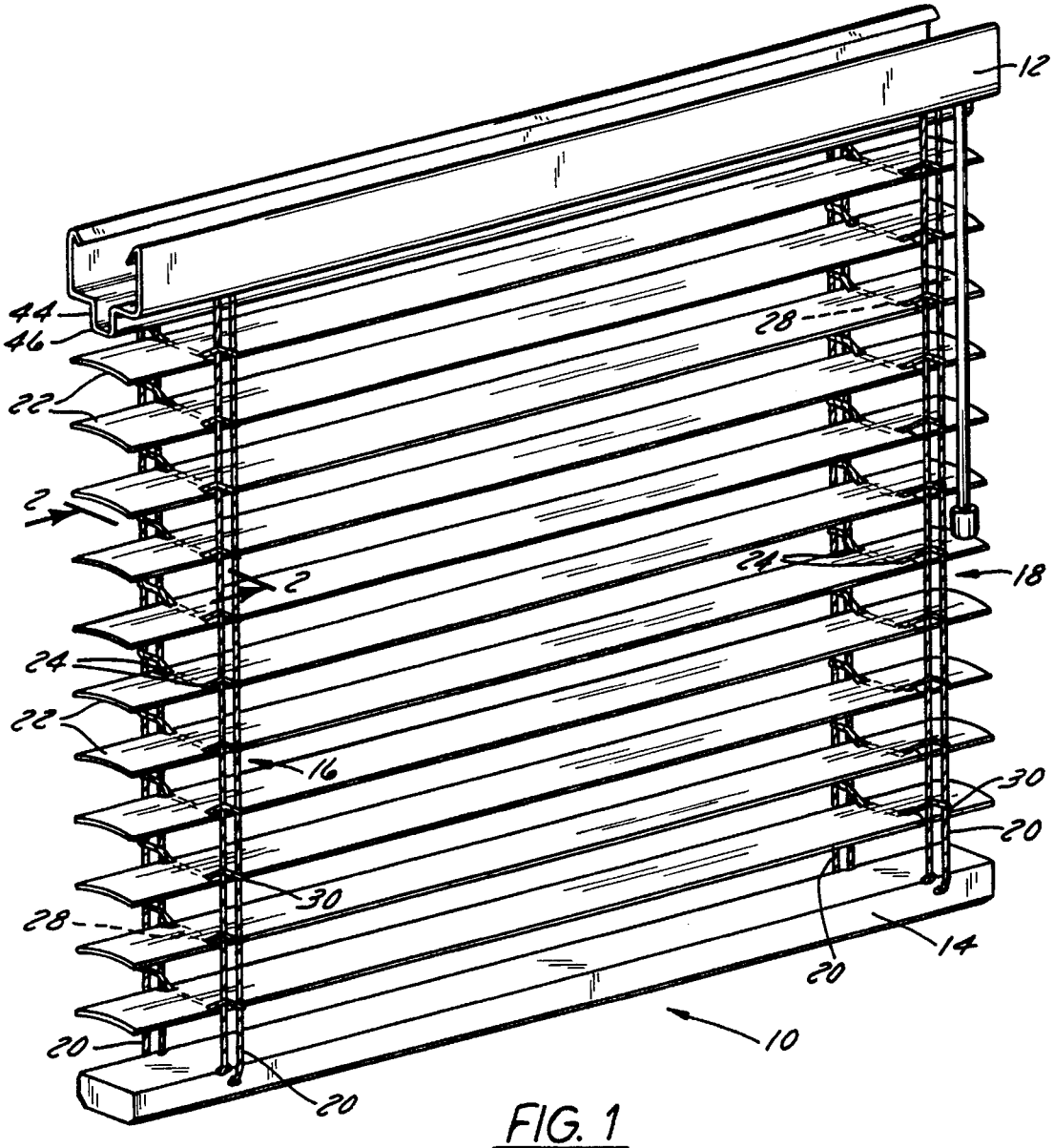
FIG. 1 is a perspective view of a venetian blind assembly in accordance with the preferred form of the present invention.

Referring to FIG. 1, a blind assembly 10 constructed in accordance with this invention is shown. As shown in FIG. 1, the blind assembly 10 includes a headrail 12, a bottom rail 14, two ladder cord assemblies 16 and 18, lift cords 20 and a plurality of slats 22. As shown in FIG. 1, each blind slat 22 is provided with two pairs of holes 24 adjacent to the opposite edges of the slat at the locations of each of the ladder cords 16 and 18. As further shown in FIG. 3, each of the holes 24 is connected to the adjacent edge of the slat 22 by a slit 26. As shown in FIG. 1, and in further detail in FIG. 2, each of the horizontal rungs 28 of the ladder cord assemblies 16 and 18 passes through one of the pairs of holes 24 in the slats 22 such that it extends over the top of the edges of each of the slats and under the center portion of each of the slats.

Figure 2:
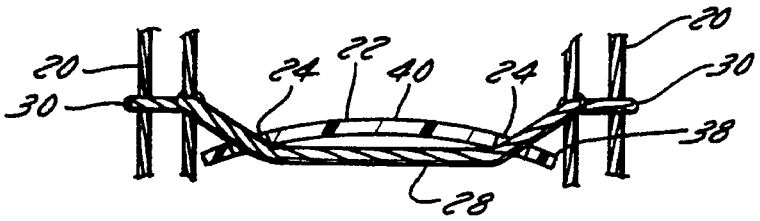
FIG. 2 is a cross-sectional view taken along the line 2—2 in FIG. 1 showing an individual slat as supported by a ladder in accordance with this invention.
Figure 3:
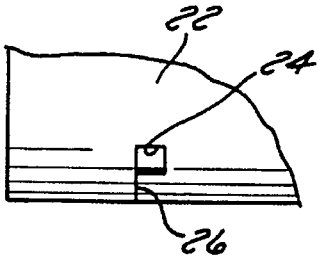
FIG. 3 is an enlarged fragmentary top plan view of a slat showing a hole and slit therein in accordance with this invention.

As may be observed in FIGS. 1 and 2, a cord loop 30 is provided in conjunction with each of the horizontal rungs 28 to receive a lift cord 20 so as to maintain the lift cords in position alongside of the ladder cord assemblies 16 and 18.

Figure 4:
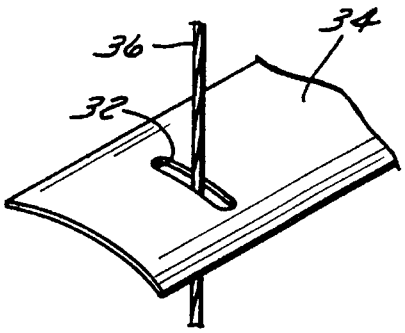
FIG. 4 PRIOR ART
FIG. 4 is a perspective view of a single slat and lift cord in accordance with the prior art.
Figure 5:
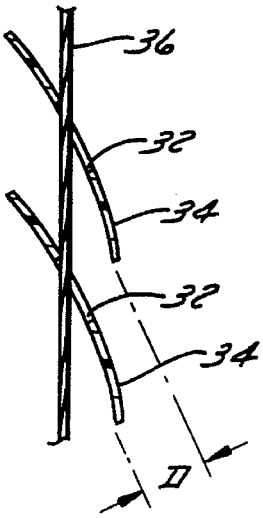
FIG. 5 PRIOR ART
FIG. 5 is a side elevation view showing a lift cord and two adjacent slats in the closed position in accordance with the prior art construction as shown in FIG. 4.

Referring to FIGS. 4 and 5, the usual construction of a venetian blind is shown wherein an elongated hole 32 is provided in the center of the slat 34 for receiving a lift cord 36. As shown in FIG. 5, due to the presence of the lift cord 36, the lower edge of one slat cannot be brought into contact with the upper surface of the next adjacent lower slat in the closed position. Rather, the slats remain spaced apart by some predetermined distance D. As could be expected, that spacing permits the direct infiltration of light and noise and also the movement of air.

Figure 6:
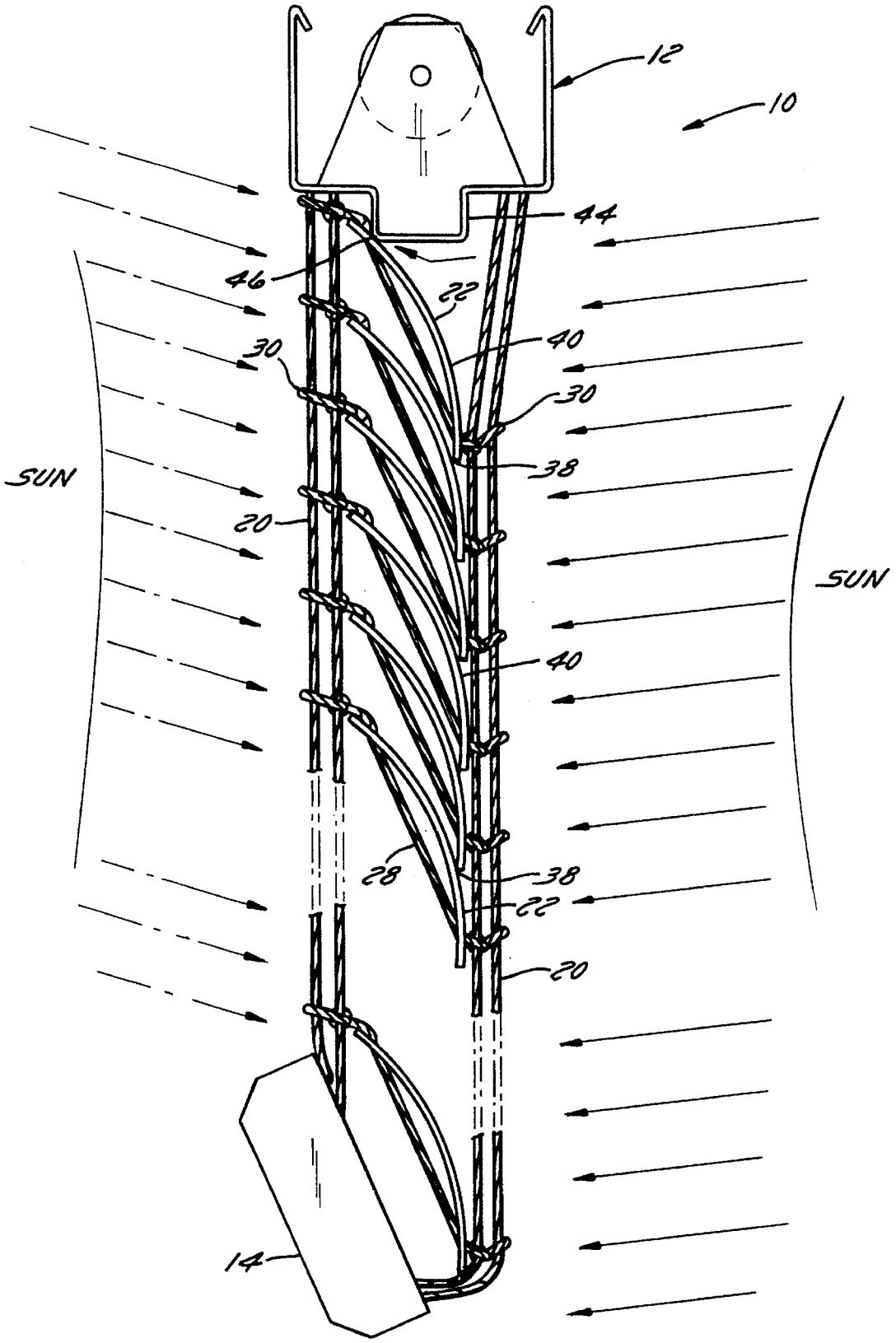
FIG. 6 is a side elevation view showing the blind assembly of FIG. 1 in the closed position.

Referring to FIG. 6, it will be seen that by utilizing the blind assembly of this invention, as shown in FIG. 1, the blind slats are permitted to fully close upon each other in the closed position. That is, for instance, the lower edge 38 of a slat 22 is brought into engagement with the upper surface 40 of the next lower slat 22. With the lower edge of a slat engaging the upper surface of the next lower slat, throughout the blind assembly, the infiltration of light and sound and the movement of air between the slats is essentially blocked. Further, it will be observed that neither the lift cords 20 nor the ladder rungs 28 interfere with the closing of the slats.

To further prevent the infiltration of light, sound and air between the headrail 12 and the uppermost slat 22, a rectangular projection 44 is provided on the bottom surface of the headrail 12. As will be seen in FIG. 6, a lower corner 46 of the projection 44 engages the upper surface of the uppermost slat 22, in a manner much similar to the engagement of the lower edge of each slat with the upper surface of the next lower slat. Thus, light and sound infiltration and the movement of air is also prevented between the headrail and the uppermost slat.

The blind assembly of this invention is also desirable with respect to the assembly of the blind and further with respect to the replacement of individual slats should that ever be necessary. In assembling the blind in accordance with this invention, the ladder cord assemblies may be hung with the rungs in a horizontal position, such that an individual slat may be inserted between the ladder vertical cords and placed upon each of the individual rungs. By applying a slight pressure to the top surface of each of the slats 22 adjacent the slit 26, the ladder rung 28 which is positioned under the slit 26 may be forced to pass therethrough and to enter into the holes 24. With the ladder rung cords 28 positioned within the holes 24, they are held in the desired position with respect to the overall blind assembly. Thus, the ladder rungs serve the same purpose, in maintaining the slats in the desired position with respect to each other, as did the lift cord 36 and the holes 32 in the prior art blind shown in FIG. 4.

Further, if for some particular reason it is necessary to replace an individual slat 22, it need merely be lifted, the rung cord removed from the holes 24 through the slits 26, and then removed from the ladder cord assemblies. A new slat may then be positioned between the ladder cord assemblies and pressed onto the ladder rungs 28 to position the rungs 28 in the holes 24.

In a particular venetian blind construction in accordance with this invention, the slats are 0.985" wide and 0.0085." thick with a 0.065" crown. The holes are square, with each side 0.062" in length and centered 0.09" from the edges of the slats. The shape of the hole is not critical, but for manufacturing efficiency, the hole should be made and the cut or slit sheared by a single stroke of a die.

It should be apparent to those skilled in the art that what has been described is considered at present to be a preferred embodiment of the venetian blind assembly of this invention. In accordance with the patent statutes, changes may be made in the venetian blind assembly without actually departing from the true spirit and scope of this invention.

For instance, in another embodiment of this invention, only one hole, rather than a pair, may be provided for each ladder rung. In one form of this embodiment, the holes are preferably provided on opposite edges of the slats, adjacent opposite ends of the slats. Further, the holes provided for adjacent ladder rungs of each ladder may be alternated between opposite edges of the slats. The engagement of the lower edge of each slat with the upper surface of the next lower slat is not as complete in this embodiment as it is in the preferred embodiment. Nevertheless, this embodiment does offer a considerable improvement over the prior art blind shown in FIGS. 4 or 5 with respect to prevent the infiltration of light and sound and the movement of air between the slats.

In a still further embodiment of this invention, again only one hole, rather than a pair, may be provided for each ladder rung. However, in this embodiment, the holes are provided adjacent the same edge of the slat, adjacent opposite ends of the slats. With this arrangement of the holes, when the slats are tilted to the closed position, with the holes located adjacent to the lower edge of the slat, the lower edge of each slat may engage the upper surface of the next lower slat, without said rung cord interfering with the contact of the lower edge of each slat with the upper surface of the next lower slat, so as to essentially prevent light infiltration between the slats when the blind slats are in their closed position. However, when the slats are tilted in the opposite direction to a closed position, the rung cords will prevent the lower edge of each slat from engaging the upper surface of the next lower slat.

The appended claims are intended to cover all such changes and modifications which fall within true spirit and scope of this invention.

We claim:

1. A venetian blind assembly including an array of elongated slats of generally equal width, which minimizes light infiltration when the slats are in their closed position, said assembly comprising in addition to said array of slats:

a headrail, a bottom rail, at least two lift cords connected between said headrail and said bottom rail and spaced from each other along the length of said rails, at least two ladder cord assemblies for tilting said slats, each of said ladder cord assemblies including two spaced vertical ladder cords between which extend a plurality of rung cords which are generally equally spaced vertically from each other, said headrail including a bottom surface along the length thereof and a projection along the length thereof below said bottom surface, said projection being generally rectangular and located generally at the center of the headrail so as to be positioned between said parallel vertical ladder cords, such that in the closed position the top surface of the uppermost slat may engage a corner of said projection so as to prevent infiltration between said uppermost slat and said headrail, each of said slats including a top surface and having a curvalinear cross section with the edges being downwardly projecting and being provided with at least two pairs of holes, said pairs of holes being spaced from each other along the length of said slats, with the holes of each of said pairs being located across the width of said slat from each other and adjacent opposite edges of said slat, each of said holes being connected to said adjacent edge of said slat by a slit, each of said rung cords being inserted into one of said pairs of holes by application of pressure to the top surface of each slat adjacent the slit to force the rung cord through the slit so as to enter said holes from above said slats and pass under the center portion of each of said slats between said holes whereby in the closed position the lower edge of each slat may engage the upper surface of the next lower slat, without said rung cord interfering with the contact of the lower edge of each slat with the upper surface of the next lower slat, so as to essentially prevent light infiltration between said slats when said blind slats are in their closed position, each said ladder cord including a cord loop in conjunction with each rung cord, each said cord loop being attached to one said vertical ladder cord at a position spaced above said slat, each said cord loop permitting said lift cord to pass therethrough for keeping each said lift cord alongside each said adjacent ladder cord and for permitting relative motion between said lift and ladder cords.

2. The venetian blind assembly of claim 1 wherein said lift cords are located outwardly of the edges of said slats.

3. The venetian blind assembly of claim 1 wherein said holes are square.

4. The venetian blind of claim 1 wherein said rung cord is spaced below the center portion disposed between the edges of said slat.

5. A venetian blind assembly including an array of elongated slats of generally equal width, which minimizes light infiltration when the slats are in their closed position, said assembly comprising in addition to said array of slats:

a headrail, a bottom rail, at least two lift cords connected between said headrail and said bottom rail and spaced from each other along the length of said rails, at least two ladder cord assemblies for tilting said slats, each of said ladder cord assemblies including two spaced vertical ladder cords between which extend a plurality of rung cords which are generally equally spaced vertically from each other, each of said slats including a top surface and having a curvalinear cross section with the edges being downwardly projecting and being provided with at least two pairs of holes, said pairs of holes being spaced from each other along the length of said slats and adjacent opposite edges of said slat, each of said holes being connected to said adjacent edge of said slat by a slit, each of said slats being configured to receive each of said rung cords into one of said pair of holes by application of pressure to the top surface of each slat adjacent the slit to force the rung cord through the slit into the holes, so as to enter said holes from above said slats and pass under the center portion of each of said slats between said holes, whereby in the closed position the entire lower edge of each slat may engage or be only slightly spaced from the upper surface of the next lower slat, so as to essentially prevent light infiltration between said slats when said blind slats are in their closed position.

6. The venetian blind of claim 5 wherein said rung cord is spaced below the center portion disposed between the edges of said slat.

7. A venetian blind assembly including an array of elongated slats of generally equal width, which minimizes light infiltration when the slats are in their closed position, said assembly comprising in addition to said array of slats:

a headrail, a bottom rail, at least two lift cords connected between said headrail and said bottom rail and spaced from each other along the length of said rails, at least two ladder cord assemblies for tilting said slats, each of said ladder cord assemblies including two spaced vertical ladder cords between which extend a plurality of rung cords which are generally equally spaced vertically from each other, said headrail including a bottom surface along the length thereof and a projection along the length thereof below said bottom surface, said projection being generally rectangular and located generally at the center of the headrail so as to be positioned between said parallel vertical ladder cords, such that in the closed position the top surface of the uppermost slat may engage a corner of said projection so as to prevent infiltration between said uppermost slat and said headrail, each of said slats including a top surface and having a curvalinear cross section with the edges being downwardly projecting and being provided with at least two pairs of holes, said pairs of holes being spaced from each other along the length of said slats and adjacent the same edge of said slat, each of said holes being connected to said adjacent edge of said slat by a slit, each of said rung cords being inserted into one of said holes by application of pressure to the top surface of each slat adjacent the slit to force the rung cord through the slit so as to enter said holes from above said slats and pass under the center portion of each of said slats between said holes, whereby when said slats are tilted to the closed position, with the holes located adjacent to the lower edge of the slat, the lower edge of each slat may engage the upper surface of the next lower slat, without said rung cord interfering with the contact of the lower edge of each slat with the upper surface of the next lower slat, so as to essentially prevent light infiltration between said slats when said blind slats are in their closed position, each said ladder cord including a cord loop in conjunction with each rung cord, each said cord loop being attached to one said vertical ladder cord at a position spaced above said slat, each said cord loop permitting said lift cord to pass therethrough for keeping each said lift cord alongside each said adjacent ladder cord and for permitting relative motion between said lift and ladder cords.

8. The venetian blind of claim 7 wherein said rung cord is spaced below the center portion disposed between the edges of said slat.

* * * * *